US006986457B2

(12) United States Patent
O'Connell et al.

(10) Patent No.: US 6,986,457 B2
(45) Date of Patent: Jan. 17, 2006

(54) PLASTIC CORRUGATED CASE

(75) Inventors: Pat O'Connell, Hershey, PA (US); Rob Beeson, Monkton, MD (US); Dave Cargile, Lititz, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/431,570

(22) Filed: May 8, 2003

(65) Prior Publication Data

US 2004/0222279 A1 Nov. 11, 2004

(51) Int. Cl.
*B65D 5/32* (2006.01)

(52) U.S. Cl. ..... 229/122.22; 206/431; 229/122.23; 229/198.2

(58) Field of Classification Search ..... 229/122.22, 229/122.23, 198.1, 198.2, 198.3, 243, 244; 220/6, 7, 62; 206/427, 431, 503, 508
See application file for complete search history.

(56) References Cited

U.S. PATENT DOCUMENTS

| | | | | | |
|---|---|---|---|---|---|
| 959,734 | A | * | 5/1910 | Hall | 229/198.1 |
| 1,687,747 | A | * | 10/1928 | Bliss | 229/122.23 |
| 2,105,964 | A | | 1/1938 | Boh | |
| 2,148,480 | A | * | 2/1939 | Larsh | 229/244 |
| 2,919,060 | A | * | 12/1959 | Daniels | 229/244 |
| 3,272,419 | A | * | 9/1966 | Vineberg | 229/122.23 |
| 3,424,365 | A | * | 1/1969 | Venturi | 220/7 |
| 3,432,061 | A | * | 3/1969 | Anderson | 220/7 |
| 3,622,063 | A | | 11/1971 | McVeigh | |
| 3,744,700 | A | * | 7/1973 | Stegmann | 229/122.23 |
| 3,935,943 | A | | 2/1976 | Meyer et al. | |
| 4,002,287 | A | * | 1/1977 | Saveth | 229/122.23 |
| 4,194,678 | A | | 3/1980 | Jasper | |
| 4,235,346 | A | * | 11/1980 | Liggett | 220/7 |
| 4,762,270 | A | * | 8/1988 | Stoll et al. | 229/122.23 |
| 4,953,702 | A | | 9/1990 | Bryan | |
| 5,039,002 | A | | 8/1991 | Spamer | |
| 5,489,038 | A | | 2/1996 | Delbrouck | |
| 5,582,312 | A | * | 12/1996 | Niles et al. | 220/7 |
| 5,687,902 | A | * | 11/1997 | Tusing et al. | 229/198.1 |
| 5,839,651 | A | | 11/1998 | Teags et al. | |
| 5,871,090 | A | | 2/1999 | Doucette et al. | |
| 6,102,280 | A | | 8/2000 | Dowd | |
| 6,223,980 | B1 | | 5/2001 | Guillin | |
| 6,241,083 | B1 | | 6/2001 | Harrelson | |
| 6,305,599 | B2 | * | 10/2001 | Tsubaki et al. | 229/122.23 |

* cited by examiner

*Primary Examiner*—Gary E. Elkins
(74) *Attorney, Agent, or Firm*—Venable LLP; James R. Burdett; Stuart L. Smith

(57) ABSTRACT

A packaging case is provided for containing at least one container. The case has a first sheet and a second sheet. The first sheet forms a first vertical panel of the case having a first edge with a first bead and a second edge with a second bead, the second edge being opposite the first edge, a first horizontal panel of the case having a first edge and a second edge opposite the first edge, and a second vertical panel of the case having a first edge with a first bead and a second edge with a second bead, the second edge being opposite the first edge. The second sheet connects to the first sheet and forms a third vertical panel of the case having a first edge with a first groove and a second edge with a second groove, the second edge being opposite the first edge, a second horizontal panel of the case having a first edge and a second edge opposite the first edge, and a fourth vertical panel of the case having a first edge with a first groove and a second edge with a second groove, the second edge being opposite the first edge. The first bead of the first vertical panel connects to the second groove of the fourth vertical panel, the second bead of the first vertical panel connects to the second groove of the third vertical panel, the first bead of the second vertical panel connects to the first groove of the fourth vertical panel, and the second bead of the second vertical panel connects to the first groove of the third vertical panel.

13 Claims, 5 Drawing Sheets

PLASTIC CORRUGATED CASE

BACKGROUND OF THE INVENTION

The invention relates to a case for containers. More particularly, the invention relates to a shipping and display case for containers.

The problem of shipping and displaying containers such as, for example, plastic bottles safely and inexpensively has resulted in the use of various containers or cases. For example, simple cardboard boxes having punch out areas that are removed at the point of sale so that the contents of the boxes can be seen by potential customers are commonly used. However, these cardboard boxes have the disadvantage of needing the punch out areas removed at the point of sale, resulting in a display case having reduced strength and the creation of waste material that must be disposed of. In addition, the strength of cardboard boxes can be greatly reduced if they become wet.

SUMMARY OF THE INVENTION

The invention provides a shipping and display case that has particular advantages over known display cases. For example, embodiments of the invention provide a strong, light and inexpensive shipping and display case for plastic bottles such as those containing motor oil. Particular embodiments of the invention provide a shipping and display case made from two extruded plastic sheets that interlock using beads formed along the edges of one sheet and grooves formed along the edges of the other sheet.

Particular embodiments of the invention provide a packaging case for containing at least one container. The case has a first sheet and a second sheet. The first sheet forms a first vertical panel of the case having a first edge with a first bead and a second edge with a second bead, the second edge being opposite the first edge, a first horizontal panel of the case having a first edge and a second edge opposite the first edge, and a second vertical panel of the case having a first edge with a first bead and a second edge with a second bead, the second edge being opposite the first edge. The second sheet connects to the first sheet and forms a third vertical panel of the case having a first edge with a first groove and a second edge with a second groove, the second edge being opposite the first edge, a second horizontal panel of the case having a first edge and a second edge opposite the first edge, and a fourth vertical panel of the case having a first edge with a first groove and a second edge with a second groove, the second edge being opposite the first edge. The first bead of the first vertical panel connects to the second groove of the fourth vertical panel, the second bead of the first vertical panel connects to the second groove of the third vertical panel, the first bead of the second vertical panel connects to the first groove of the fourth vertical panel, and the second bead of the second vertical panel connects to the first groove of the third vertical panel.

Other embodiments of the invention provide a shipping and display system having a plurality of containers and a case. The case has a first sheet and a second sheet. The first sheet forms a first vertical panel of the case having a first edge with a first bead and a second edge with a second bead, the second edge being opposite the first edge, a first horizontal panel of the case having a first edge and a second edge opposite the first edge, and a second vertical panel of the case having a first edge with a first bead and a second edge with a second bead, the second edge being opposite the first edge. The second sheet connects to the first sheet and forms a third vertical panel of the case having a first edge with a first groove and a second edge with a second groove, the second edge being opposite the first edge, a second horizontal panel of the case having a first edge and a second edge opposite the first edge, and a fourth vertical panel of the case having a first edge with a first groove and a second edge with a second groove, the second edge being opposite the first edge. The first bead of the first vertical panel connects to the second groove of the fourth vertical panel, the second bead of the first vertical panel connects to the second groove of the third vertical panel, the first bead of the second vertical panel connects to the first groove of the fourth vertical panel, and the second bead of the second vertical panel connects to the first groove of the third vertical panel. The plurality of containers are contained within the case.

Other embodiments of the invention provide a method of making a packaging case. The case has a first sheet and a second sheet. The first sheet forms a first vertical panel of the case having a first edge with a first bead and a second edge with a second bead, the second edge being opposite the first edge, a first horizontal panel of the case having a first edge and a second edge opposite the first edge, and a second vertical panel of the case having a first edge with a first bead and a second edge with a second bead, the second edge being opposite the first edge. The second sheet connects to the first sheet and forms a third vertical panel of the case having a first edge with a first groove and a second edge with a second groove, the second edge being opposite the first edge, a second horizontal panel of the case having a first edge and a second edge opposite the first edge, and a fourth vertical panel of the case having a first edge with a first groove and a second edge with a second groove, the second edge being opposite the first edge. The first bead of the first vertical panel connects to the second groove of the fourth vertical panel, the second bead of the first vertical panel connects to the second groove of the third vertical panel, the first bead of the second vertical panel connects to the first groove of the fourth vertical panel, and the second bead of the second vertical panel connects to the first groove of the third vertical panel. The method includes extruding the first sheet from plastic, extruding the second sheet from plastic, and assembling the first and second sheets. The first and second sheets are assembled such that the first bead of the first vertical panel connects to the second groove of the fourth vertical panel, the second bead of the first vertical panel connects to the second groove of the third vertical panel, the first bead of the second vertical panel connects to the first groove of the fourth vertical panel, and the second bead of the second vertical panel connects to the first groove of the third vertical panel.

BRIEF DESCRIPTION OF THE DRAWINGS

The invention is explained below in further detail with the aid of exemplary embodiments shown in the drawings, wherein.

DETAILED DESCRIPTION OF THE INVENTION

The invention is explained in the following with the aid of the drawings in which like reference numbers represent like elements.

Figure 1:
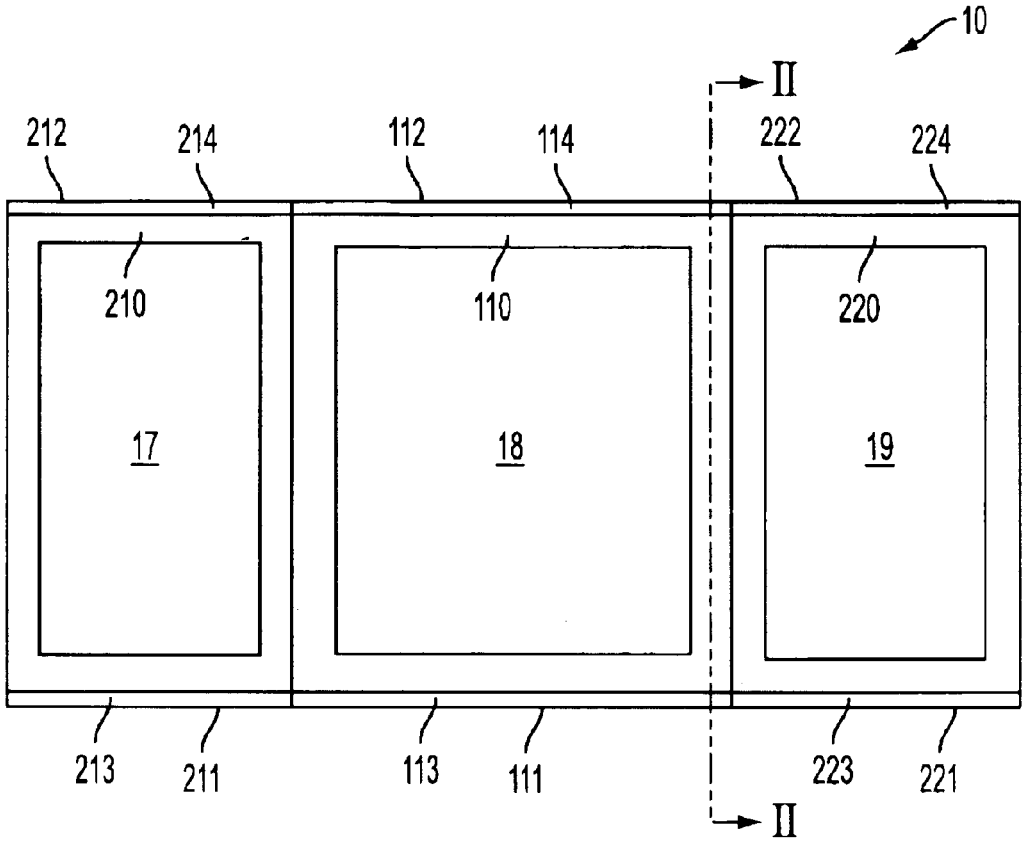
FIG. 1 is a plan view of a first sheet of a case in accordance with the invention.
Figure 2:
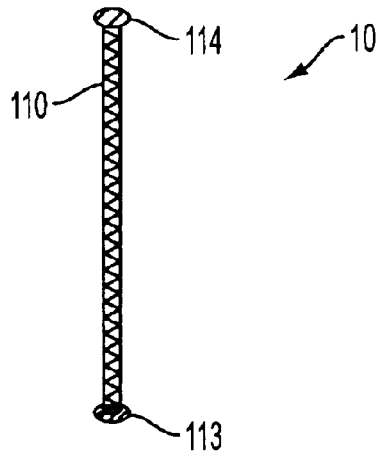
FIG. 2 is a sectional view along section line II—II in FIG. 1.
Figure 3:
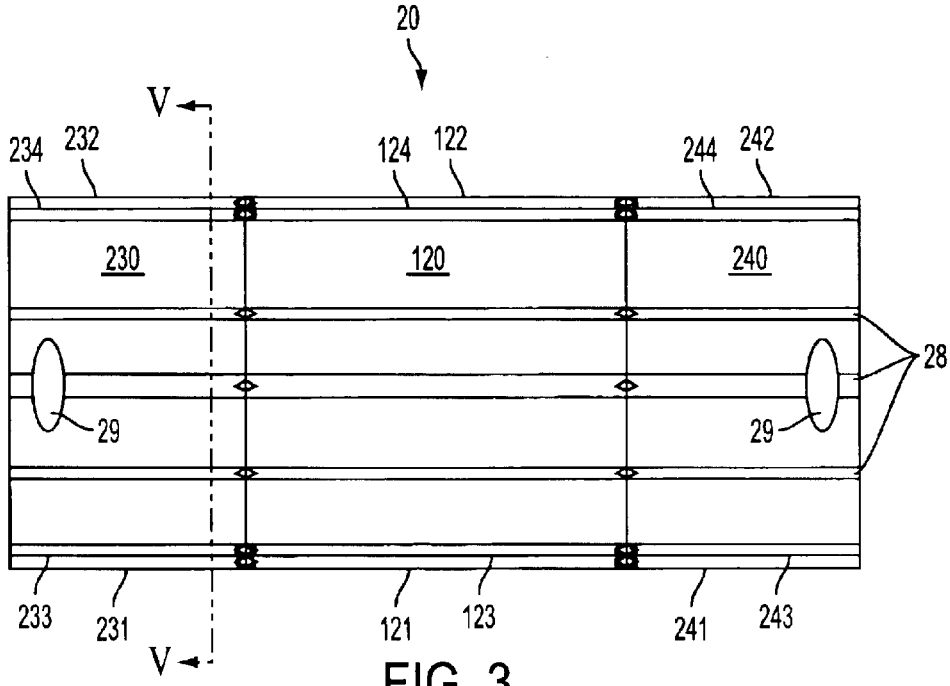
FIG. 3 is a plan view of a second sheet of a case in accordance with the invention.
Figure 4:
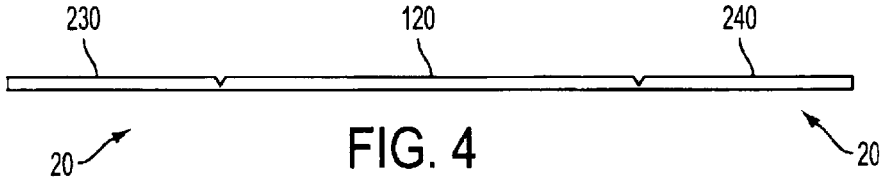
FIG. 4 is a side view of the second sheet shown in FIG. 3.
Figure 5:
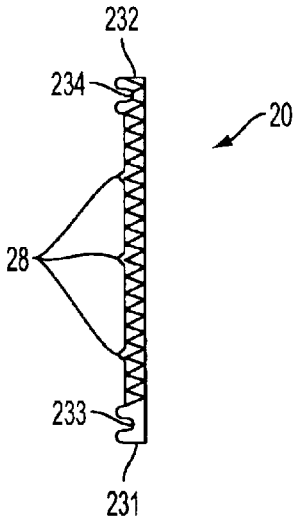
FIG. 5 is a sectional view along section line V—V in FIG. 3.

The Figures show an example of a case in accordance with the invention configured to hold, for example, a plurality of plastic bottles. FIGS. 1 and 2 show a first sheet 10 and FIGS. 3–5 show a second sheet 20 that, when assembled together, form a shipping and display case in accordance with the invention. The sheets can be manufactured, for example, out of HDPE flake. Virgin flake, post-industrial flake, or a mixture of the two can be used. Other materials can be blended with the flake, such as, for example, colorant or calcium carbonate. As shown in FIG. 1, first sheet 10 has a first vertical panel 210, a first horizontal panel 110 and a second vertical panel 220. It is noted that the descriptive names given to the various panels relate to their position after assembly of the case, and not to their orientation in FIG. 1. For example, first vertical panel 210 and second vertical panel 220 are in substantially vertical positions after the case is assembled. First vertical panel 210 has a first edge 211 and a second edge 212. In this example, a first bead 213 is located at first edge 211 and a second bead 214 is located at second edge 212. Similarly, second vertical panel 220 has a first edge 221 with a first bead 223 and a second edge 222 with a second bead 224. First horizontal panel 110 has a first edge 111 and a second edge 112. In some embodiments, first horizontal panel 110 has a first bead 113 at first edge 111 and a second bead 114 at second edge 112.

FIG. 2 shows a cross section of sheet 10 taken along section line II—II in FIG. 1. As can be seen from FIG. 2, first bead 113 and second bead 114 are portions that are thicker than a main portion of first horizontal panel 110. Beads 213, 214, 223, 224 can be similar to beads 113, 114.

As will be discussed below, some or all of beads 113, 114, 213, 214, 223, 224 interact with corresponding grooves in second sheet 20. In the example shown in FIG. 1, first beads 213, 113, 223 are colinear when first sheet 10 is laid flat. Similarly, in this example, second beads 214, 114, 224 are colinear when first sheet 10 is laid flat. However, it is conceivable that other embodiments of the invention could provide beads that are not colinear along the entire edge of first sheet 10. In addition, particular embodiments may not include first bead 113 and/or second bead 114.

FIG. 1 also shows openings 17, 18, 19 in first vertical panel 210, first horizontal panel 110 and second vertical panel 220, respectively. Openings 17, 18, 19 can be left open or can be covered with, for example, a transparent plastic film to protect the contents of the case while still allowing the contents to be viewed from outside the case. By using a material such as, for example, plastic to form first vertical panel 210, first horizontal panel 110 and second vertical panel 220, first sheet 10 can be sufficiently strong once assembled with second sheet 20 to allow openings 17, 18, 19 to be created prior to the case being shipped with its contents. By allowing openings 17, 18, 19 to be formed prior to use of the case, the material removed from first vertical panel 210, first horizontal panel 110 and second vertical panel 220 to form openings 17, 18, 19 can be recycled more efficiently. While the Figures show first sheet 10 having three openings 17, 18, 19, and second sheet 20 having no openings, it is noted that fewer or more than three openings can be provided. For example, second sheet 20 can have openings on one or both of third vertical panel 230 and fourth vertical panel 240.

The cross section of first sheet 10, as shown in FIG. 2, is uniform along the entire length of first sheet 10 except for openings 17, 18, 19. This allows first sheet 10 to be formed by extrusion, resulting in relatively low manufacturing costs.

FIGS. 3–5 show an example of second sheet 20 that can be assembled with first sheet 10 to form the case. As shown in FIG. 3, second sheet 20 has a third vertical panel 230, a second horizontal panel 120 and a fourth vertical panel 240. As in FIG. 1, FIG. 3 shows a plan view in which the sheet is laid flat. Third vertical panel 230 has a first edge 231 and a second edge 232. A first groove 233 is located along first edge 231 and a second groove 234 is located along second edge 232. Similarly, fourth vertical panel 240 has a first edge 241 having a first groove 243 and a second edge 242 having a second groove 244. Second horizontal panel 120 has a first edge 121 and a second edge 122. In particular embodiments, first edge 121 has a first groove 123 and second edge 122 has a second groove 124. As will be discussed further below, various ones of first grooves 233, 123, 243 and second grooves 234, 124, 244 connect with various ones of first beads 213, 113, 223 and second beads 214, 114, 224 when the case is assembled.

In this example, second sheet 20 has a plurality, in this case three, ridges 28 for providing improved rigidity of second sheet 20. Also provided are handles in the form of openings 29 in third vertical panel 230 and fourth vertical panel 240.

Figure 6:
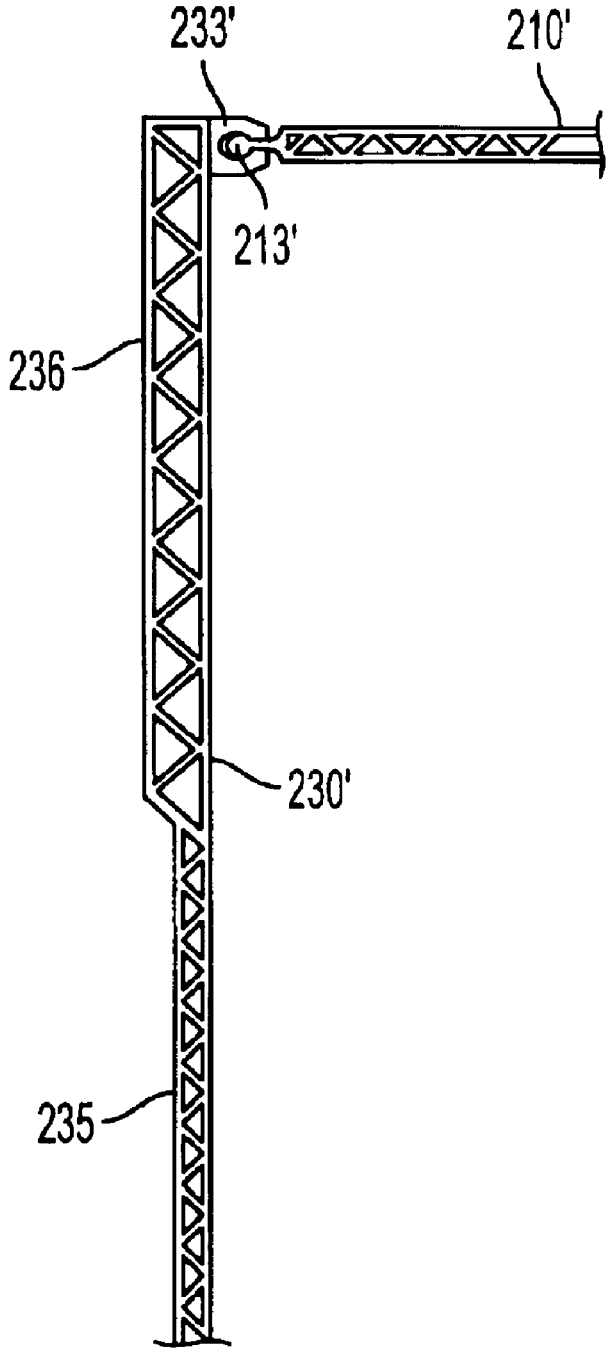
FIG. 6 is a detailed view of a connection between two sheets of a case in accordance with the invention.

FIG. 6 shows a detail of the bead/groove connection between a first vertical panel 210' and a third vertical panel 230' of a preferred embodiment. In this embodiment, third vertical panel 230' has a normal wall section 235 and a thickened wall section 236. Thickened wall section 236 provides increased strength along the edges of third vertical panel 230' in order to better support the connection of first bead 213' and first groove 233'. While the structure shown in FIG. 6 of third vertical panel 230' may be more complicated than the structure of third vertical panel 230 shown in FIGS. 3–5, it is still possible to form third vertical panel 230' by an extrusion process. Therefore, it can be manufactured relatively inexpensively. Thickened wall section 236 can also provide an interlocking feature for greater stacking stability during shipping and storing.

Figure 7:
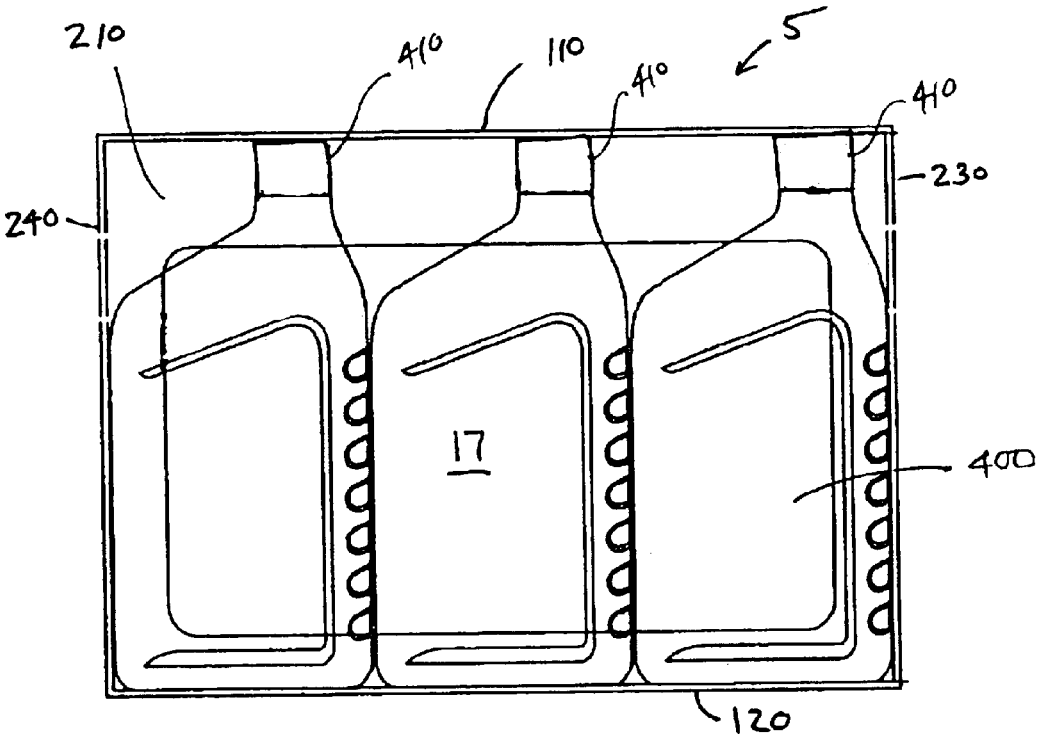
FIG. 7 is a side view of an embodiment of the invention.
Figure 8:
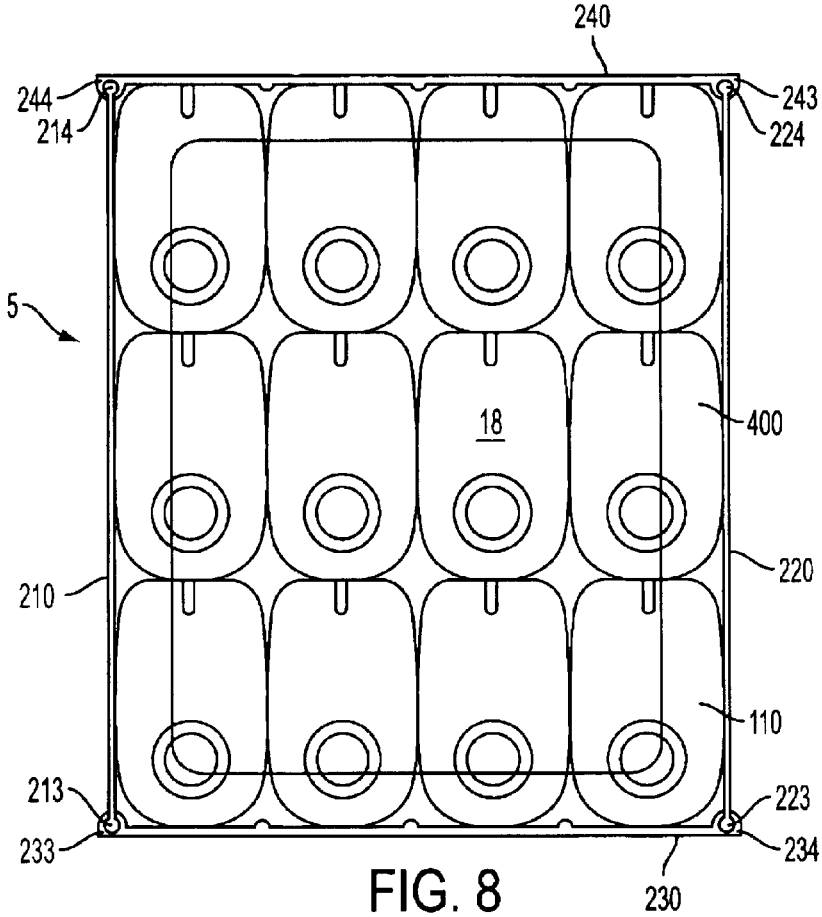
FIG. 8 is a top view of the embodiment shown in FIG. 7.
Figure 9:
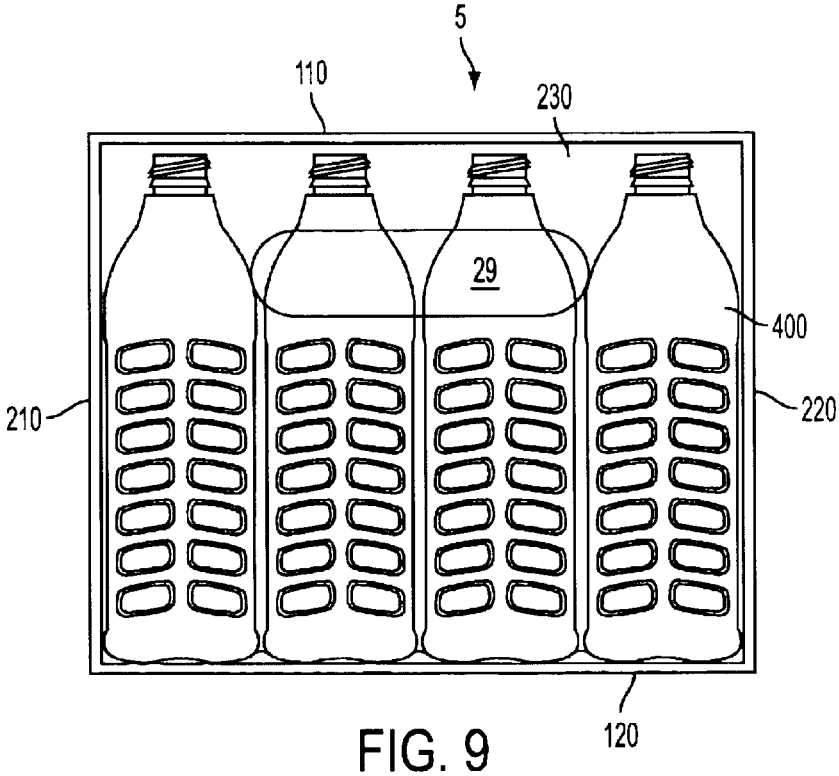
FIG. 9 is an end view of the embodiment shown in FIGS. 7 and 8.

FIGS. 7–9 show an example of a case 5 assembled from first sheet 10 and second sheet 20. FIG. 7 is a side view of case 5 looking directly at first vertical panel 210 of first sheet 10. First horizontal panel 110 of first sheet 10 forms the top of case 5 and second vertical panel 220 of first sheet 10 forms the back of case 5 (not visible in FIG. 7). Third vertical panel 230 of second sheet 20 forms the right side of case 5, second horizontal panel 120 of second sheet 20 forms the bottom of case 5 and fourth vertical panel 240 of second sheet 20 forms the left side of case 5. FIG. 8 shows the connection at the four vertical edges of case 5 between the various beads and grooves of first sheet 10 and second sheet 20. It is noted that, in this example, there are no horizontal connections between any of the beads and grooves. Because the interaction between first sheet 10 and second sheet 20, in this example, results in no horizontal connections between any of the beads and grooves, it is possible to omit first bead 113 and second bead 114 of first horizontal panel 110 and first groove 123 and second groove 124 of second horizontal panel 120. However, in the interest of manufacturing efficiency, these beads and grooves are preferably formed even though they may not be used in forming a connection between first sheet 10 and second sheet 20.

FIGS. 7–9 show case 5 containing a plurality, in this example 12, plastic bottles 400 having tops 410. One of the considerations when designing a plastic bottle is the bottle's ability to support top loading during stacking and shipping. In particular embodiments of the invention, case 5 is designed for use with a particular number of a specific bottle 400 so that the entire system (case 5 plus bottles 400) provide the required top load strength. By using both bottles 400 and case 5 to provide a portion of the total top load strength required, it is possible to reduce the top load strength required by each bottle 400. For example the case 5 can provide support for more than 10% or more than 20% of the top load force. By reducing the top load strength required for each bottle 400, each bottle 400 can be produced using less plastic material and, therefore, less expensively.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A packaging case for containing at least one container, the case comprising:

a first sheet that forms a first vertical panel of the case having a first edge with a first bead and a second edge with a second bead, the second edge being opposite the first edge, a first horizontal panel of the case having a first edge, the first edge having a first bead, and a second edge opposite the first edge, the second edge having a second bead, and a second vertical panel of the case having a first edge with a first bead and a second edge with a second bead, the second edge being opposite the first edge; and a second sheet that connects to the first sheet and forms a third vertical panel of the case having a first edge with a first groove and a second edge with a second groove, the second edge being opposite the first edge, a second horizontal panel of the case having a first edge, the first edge having a first groove, and a second edge opposite the first edge, the second edge having a second groove, and a fourth vertical panel of the case having a first edge with a first groove and a second edge with a second groove, the second edge being opposite the first edge, wherein the first bead of the first vertical panel connects to the second groove of the fourth vertical panel, the second bead of the first vertical panel connects to the second groove of the third vertical panel, the first bead of the second vertical panel connects to the first groove of the fourth vertical panel, the second bead of the second vertical panel connects to the first groove of the third vertical panel, when the first sheet is laid flat, the first beads of the first vertical panel, the first horizontal panel and the second vertical panel are co-linear, and the second beads of the first vertical panel, the first horizontal panel and the second vertical panel are co-linear, and when the second sheet is laid flat, the first grooves of the third vertical panel, the second horizontal panel and the fourth vertical panel are co-linear, and the second grooves of the third vertical panel, the second horizontal panel and the fourth vertical panel are co-linear.

2. The case of claim 1, wherein the first sheet has a partially hollow cross section.

3. The case of claim 2, wherein the second sheet has a partially hollow cross section.

4. The case of claim 1, wherein the second sheet as a partially hollow cross section.

5. A shipping and display system comprising:

a plurality of containers; and the case of claim 1, wherein the plurality of containers are contained within the case.

6. The system of claim 5, wherein the case and at least a portion of the plurality of containers are for jointly supporting a top load force to which the portion of the plurality of containers are to be subjected.

7. The system of claim 6, wherein the case and the plurality of containers are for jointly supporting a top load force to which the plurality of containers and the case are to be subjected.

8. The system of claim 5, wherein one of the first horizontal panel and the second horizontal panel is a top of the case and has an underside surface, at least one of the plurality of containers has a top surface, the underside surface of the top of the case rests on the top surface of the at least one container when the case is subjected to a top load force, and the case is designed so that the case supports a predetermined amount of the top load force.

9. The system of claim 8, wherein the predetermined amount is more than 10% of the top load force.

10. The system of claim 9, wherein the predetermined amount is more than 20% of the top load force.

11. A packaging case for containing at least one container, the case comprising:

a first sheet that forms a first vertical panel of the case having a first edge with a first bead and a second edge with a second bead, the second edge being opposite the first edge, a first horizontal panel of the case having a first edge and a second edge opposite the first edge, and a second vertical panel of the case having a first edge with a first bead and a second edge with a second bead, the second edge being opposite the first edge; and a second sheet that connects to the first sheet and forms a third vertical panel of the case having a first edge with a first groove and a second edge with a second groove, the second edge being opposite the first edge, a second horizontal panel of the case having a first edge and a second edge opposite the first edge, and a fourth vertical panel of the case having a first edge with a first groove and a second edge with a second groove, the second edge being opposite the first edge, wherein the first bead of the first vertical panel connects to the second groove of the fourth vertical panel, the second bead of the first vertical panel connects to the second groove of the third vertical panel, the first bead of the second vertical panel connects to the first groove of the fourth vertical panel, the second bead of the second vertical panel connects to the first groove of the third vertical panel and, wherein the first edge of one of the third vertical panel and the fourth vertical panel is thicker than a central region of the second sheet.

12. The case of claim 11, wherein the second edge of one of the third vertical panel and the fourth vertical panel is thicker than a central region of the second sheet.

13. The case of claim 1, wherein the first bead of the first vertical panel extends along the entire length of the first edge of the first vertical panel and the second bead of the first vertical panel extends along the entire length of the second edge of the first vertical panel;

the first bead of the first horizontal panel extends along the entire length of the first edge of the first horizontal panel and the second bead of the first horizontal panel extends along the entire length of the second edge of the first horizontal panel;

the first bead of the second vertical panel extends along the entire length of the first edge of the second vertical panel and the second bead of the second vertical panel extends along the entire length of the second edge of the second vertical panel;

the first groove of the third vertical panel extends along the entire length of the first edge of the third vertical panel and the second groove of the third vertical panel extends along the entire length of the second edge of the third vertical panel;

the first groove of the second horizontal panel extends along the entire length of the first edge of the second horizontal panel and the second groove of the second horizontal panel extends along the entire length of the second edge of the second horizontal panel; and the first groove of the fourth vertical panel extends along the entire length of the first edge of the fourth vertical panel and the second groove of the fourth vertical panel extends along the entire length of the second edge the fourth vertical panel.

* * * * *

UNITED STATES PATENT AND TRADEMARK OFFICE

CERTIFICATE OF CORRECTION

PATENT NO. : 6,986,457 B2
APPLICATION NO. : 10/431570
DATED : January 17, 2006
INVENTOR(S) : O'Connell et al.

It is certified that error appears in the above-identified patent and that said Letters Patent is hereby corrected as shown below:

Title page,
Item [*] Notice, delete "by 0 days" and insert -- by 96 days --.

Signed and Sealed this

Twentieth Day of June, 2006

JON W. DUDAS
*Director of the United States Patent and Trademark Office*